United States Patent [19]

Wood et al.

[11] 4,398,483

[45] Aug. 16, 1983

[54] VEE TYPE PLANING HULL WITH AFT TAPERED WEDGES

[75] Inventors: Forrest L. Wood, Flippin; Dale H. Jensen, Everton; Kenneth P. Poley, Yellville; Charles C. Hoover, Bull Shoals; Gary L. Wilson, Flippin, all of Ark.

[73] Assignee: Wood Manufacturing Company, Incorporated, Flippen, Ark.

[21] Appl. No.: 285,021

[22] Filed: Jul. 20, 1981

[51] Int. Cl.[3] ..... B63B 1/18

[52] U.S. Cl. ..... 114/56; 114/271; 114/291

[58] Field of Search ..... 114/56, 62, 288, 291, 114/65 R, 271

[56] References Cited

U.S. PATENT DOCUMENTS

| | | | |
|---|---|---|---|
| 2,969,760 | 1/1961 | Eddy | 114/291 |
| 4,233,920 | 11/1980 | Wood | 114/56 |
| 4,361,102 | 11/1982 | Wood et al. | 114/291 X |

*Primary Examiner*—Sherman D. Basinger

*Attorney, Agent, or Firm*—Colton & Stone, Inc.

[57] ABSTRACT

Porpoising control in a high speed planing hull is effected during straight, on plane running and in turning maneuvers by a novel configuration of aft tapered wedges bridging the aft, exit ends of the outboard and next adjacent, inboard running surfaces.

4 Claims, 4 Drawing Figures

VEE TYPE PLANING HULL WITH AFT TAPERED WEDGES

BACKGROUND OF THE INVENTION

The invention relates to open power boats of the type used in fishing tournaments and other recreational boating and particularly to the hull configuration thereof.

In those vee entry boats rated for 140 h.p. and having top speeds in excess of 50 m.p.h., with which the invention is particularly concerned, the choice of hull configuration has conventionally involved various trade offs among the more desirable criteria which include safety and fuel economy on the one hand and high speed performance on the other. The significance of these trade offs is particularly evidenced, by conventional planing hulls, in the individual and collective control of porpoising and stern slippage in high speed turns and in porpoising when running "full out" on plane. In both situations it is necessary to come substantially off speed to achieve the increased wetted area necessary for stern tracking stability and/or to control porpoising. This, of course, produces a significant increase in drag with a concomitant decrease in fuel efficiency both in instituting the stabilizing maneuver and subsequently bringing the boat back to speed. It is the purpose of the invention to resolve these conventional trade offs as related to porpoising and high speed course corrections.

High speed turns are one of the more dangerous boating maneuvers and are particularly unforgiving of the novice boater who has not mastered the "feel" for coordinating trim and throttle adjustments at the inception, and during execution, of the turn. Indeed, it is the rare expert who, even when throttling back from top speed and entering a proper trim adjustment, has not felt unanticipated stern slippage or "chine walk" and porpoising associated with such maneuvers that are wont to capsize the boat.

The prudent boater thus comes substantially off speed to execute a sharp turn. The decrease in speed results in a greater wetted area of the hull, puts more chines in the water and reduces the magnitude, or arc, of the lay over angle which the outer running surface of the hull on the inside of a turn makes with the water surface. The consequence of the latter is that with a lesser arc of downward movement in a given time frame the laying over of the outer running surface into wetting contact does not produce the violent slapping and bouncing from the surface that initiates repeated slapping impacts contributing to the stern slippage that is characteristic of a high speed turn under full throttle where the arc of descent is substantially greater from the full on plane position. Additionally, the greater wetted area in an off speed turn places more of the after running surface wedges in hard water producing a bow down attitude to reduce porpoising in a turn.

The foregoing is the typical performance of conventional vee hulls having the usual planar running surfaces, separated by chines, on either side of the keel line running surface which lateral, planar running surfaces and the central keel line running surfaces, when viewed in transverse section adjacent the aft end of the boat, exhibit a typical V shape terminating, laterally, at outer chines continuous with the sides of the boat.

As related to the present invention, it is important to note that prior art hulls of the type herein contemplated have either been devoid of after wedges or the same have been confined to running surfaces inboard of the outermost running surfaces.

A primary purpose of the after wedges is to reduce porpoising and where the transom is notched or "stepped" as in the present boat the presence of after wedges at the aft end of those running surfaces immediately straddling the stepped portion of the transom are particularly important in the control of high speed porpoising since that is the only portion of the extreme aft end of the boat that is in "hard water". Stated differently, where the after end of the keel line and its associated running surfaces terminate short of the stern (in a transverse "step") the only remaining hull area in hard water, on plane, where a bow down torque can be maximally exerted is at the aft end of the running surfaces immediately straddling the "step". The disclosure in applicant's U.S. Pat. No. 4,233,920 is exemplary.

A necessary trade off for this porpoising control is some increase in drag because of the laminar exit flow disruption from the running surfaces as a function of the downward (stern lifting) flow component imparted by the wedges. Conventionally, this drag factor is substantially uniform across the width of the running surface whose exit ends terminate in wedges since the wedges extend straight across, or perpendicular to, the running surfaces from chine to chine. The laminar flow disruptions created thereby also tend to produce cavitation at high speeds.

In the case of high speed turns the conventional, after center wedge on the outside of the turn is out of the water so that the entire porpoising, or bow down attitude, control falls upon the central wedge or wedges on the inside of the turn. For such central wedges to impose a sufficient bow down torque to control porpoising in a high, or "full out," speed turn the necessary depth and width of the same are such as to impose unacceptable drag during straight running. This for the reason that all the central wedges are in hard water during straight running and it will be apparent that doubling the desired turn drag would drastically reduce top speed performance. Conventional wisdom has avoided the placement of after wedges on the outboard running surfaces because of the likelihood of cavitation when sharply "laying over" in a high speed turn and because of the large increase in drag in the low speed mode when the outer running surfaces are in hard water.

SUMMARY OF THE INVENTION

The invention relates to the shape, positionment and coacting relationship of after wedges on those central running surfaces immediately straddling a stepped or notched transom and on the outermost running surfaces.

The desired porpoising control for straight on plane running with negligible drag penalty is achieved by the use of aft tapering wedges extending across the full, aft width of the running surface pair immediately straddling the transom step. More specifically, and defined in terms of the fore and aft chine lines demarking the inner and outer limits of the running surface pair immediately straddling the transom step; each wedge tapers aft from the inboard chine line to terminate at the extreme aft end of the outboard chine line. The effect, in high and mid speed running on plane, where the hull surfaces outboard thereof are out of hard water, is to shift water laterally (produce yawing torque vectors adding to zero) in addition to the lift, producing a bow down attitude, to be expected from after wedges in hard water. The lateral shift component at the aft end of the running surfaces allows sufficient exit of the water directed toward the outboard chines to "clear" the running surfaces and thus avoid that characteristic cavitation associated with conventional, transverse wedges in the high speed on plane mode.

Porpoising control in high speed turns is controlled in an analagous fashion, using tapered wedges at the aft ends of the outboard running surfaces, but wherein the aft taper extends in the opposite direction, i.e. from a forward position of the outboard chine line to the extreme aft end of the inboard chine line. One purpose, when laying over, is to place the maximum wedge surface in hard water at the inception of a turn. As the turn is tightened, hard water wedge surface is gradually increased, producing an increasing bow down attitude as well as allowing clean aft slippage of water along the tapered wedge to avoid cavitation.

The coaction of these oppositely tapered wedges to control "chine walk" in a sharply executed turn is explainable on the basis that the slapping impact from a sharply laid over hull under full power is ameliorated by the ready exit outflow from the outer running surface along the tapered wedges while yet retaining porpoising control by virtue of the lift exerted at the forwardmost (outboard) end of the tapered wedges.

DESCRIPTION OF THE DRAWINGS

The drawings are substantially to scale.

In the drawings.

DESCRIPTION OF THE PREFERRED EMBODIMENT

Figure 2:
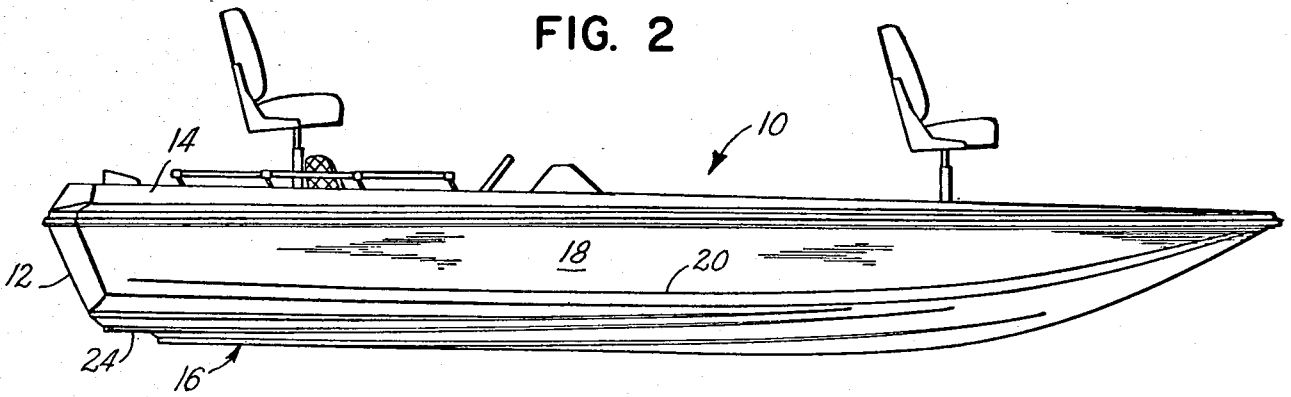
FIG. 2 is a side elevation of the power boat shown in FIG. 1.
Figure 1:
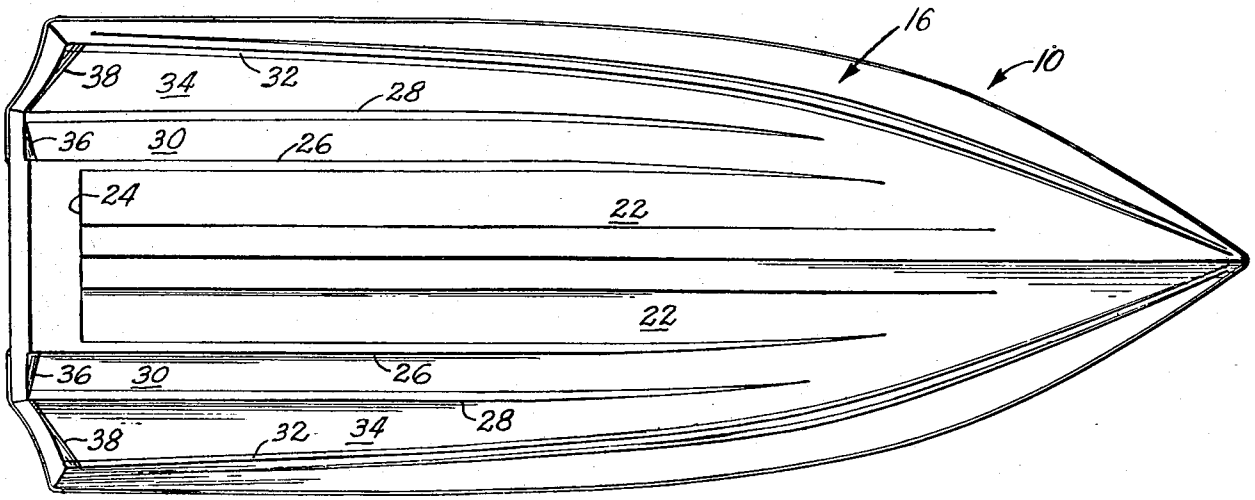
FIG. 1 is a bottom plan view of a power boat incorporating the hull of the present invention.
Figure 3:
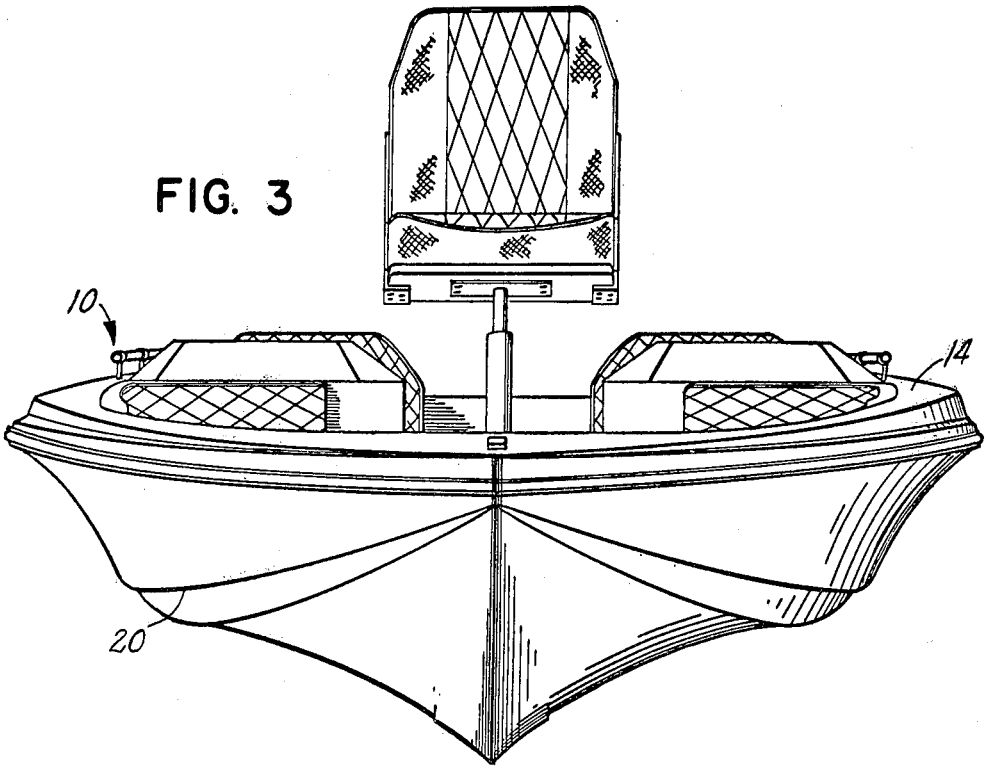
FIGS. 3 and 4 are front and rear elevations, respectively, of the power boat.
Figure 4:
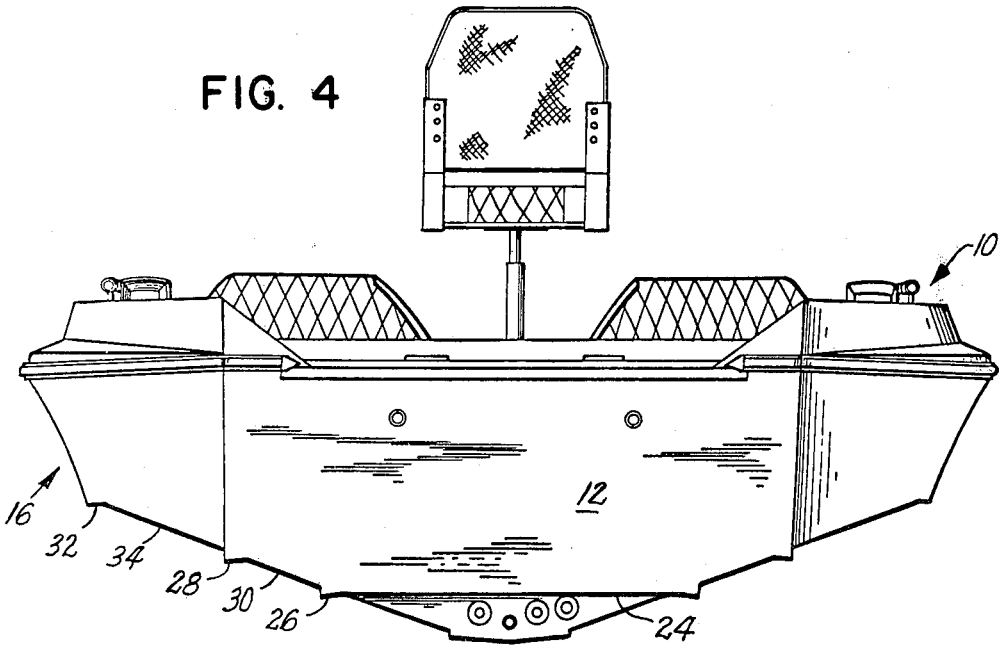

In FIGS. 1–4 is illustrated an open power boat 10, which may be driven by an outboard propulsion unit (not shown) mounted to transom 12, including a deck portion 14 surmounting the novel deep vee entry hull 16 which is the subject matter of the present invention.

The purpose of the novel hull construction is to control porpoising in both straight, on plane running and high speed turning maneuvers.

Hull 16 includes side walls 18 in which are integrally formed spray rails 20 extending foward from adjacent the stern to terminate at the bow immediately adjacent the gunwale. The after centerline keel portion and its associated running surfaces 22 terminate well forward of transom 12 in a transverse "step" or notch 24. Chine pairs 26 and 28 extend aft to transom 12 and define the inboard and outboard limits, respectively, of a pair of planar running surfaces 30 immediately straddling notch 24. Outboard chine pairs 32 extend aft to the stern of the boat and define the outboard limits of outer running surfaces 34 whose inboard limits are delimited by chine pair 28.

Tapered wedges 36 extend across the aft end of running surfaces 30 which immediately straddle notch 24. Each wedge 36 tapers aft from inboard chine 26 to terminate at the extreme aft end of outboard chine 28. The tapered wedge construction provides antiporpoising lift as the stern during high and mid speed, on plane running while producing a lateral outflow component which, in a boat driven by its rated 140 h.p. propulsion plant and operating at speeds up to and in excess of 50 m.p.h., greatly reduces the drag and substantially eliminates the cavitation typically associated with the use of conventional transverse wedges in a similarly powered and configured boat.

The outboard running surfaces 34 terminate at their aft ends in similar, but oppositely directed, tapered wedges 38. Thus, wedges 38 taper from a forward position at chines 32 aft to the extreme aft ends of chines 28. The result is to place maximum wedge surface in hard water in a high speed turn and exert maximum lift on the extreme inside of the turn while still providing sufficient exit flow from running surface 34, along rearwardly tapered wedges 38, to avoid chine walk and cavitation in a high speed turn.

The on plane and particularly the turning capabilities of the hull herein disclosed are quite remarkable. Production models of the present hull design are routinely put through 50 m.p.h., 360° turns without throttle or trim adjustments. Chine walk and porpoising on turn are virtually eliminated.

We claim:

1. A deep vee entry hull having central, intermediate and outboard running surfaces extending fore and aft thereof intermediate the bow and stern; said intermediate running surfaces extending to said stern; said intermediate and outboard running surfaces being smoothly continuous throughout their lengths and terminating at the extreme after ends thereof in wedge means extending across the full widths thereof; and said wedge means being tapered aft.

2. A deep vee entry hull having central, intermediate and outboard running surfaces extending fore and aft thereof intermediate the bow and stern; said central running surfaces terminating at the after end thereof in a transverse step immediately adjacent and forward of the stern; said intermediate running surfaces extending to said stern and straddling said transverse step; said intermediate and outboard running surfaces being smoothly continuous throughout their lengths and terminating at the extreme after ends thereof in wedge means extending across the full widths thereof; and said wedge means being tapered aft.

3. The deep vee entry hull of claim 2 including inboard and outboard chine pairs respectively defining the inboard and outboard limits of said intermediate and outboard running surfaces at the aft ends thereof; the outer running surface wedge means extending aft from the outboard chine pair of said outboard running surfaces to merge with the extreme aft end of the inboard chine pair of said outer running surfaces, and the intermediate running surface wedge means extending aft from the inboard chine pair of said intermediate running surfaces to merge with the extreme aft end of the outboard chine pair of said intermediate running surfaces.

4. The deep vee entry hull of claim 3 wherein the outboard chine pair of said intermediate running surfaces and said inboard chine pair of said outboard running surfaces constitute a common chine pair.

* * * * *